US007753737B2

(12) United States Patent
Yang et al.

(10) Patent No.: US 7,753,737 B2
(45) Date of Patent: Jul. 13, 2010

(54) FLOATING ELECTRICAL CONNECTOR ASSEMBLY

(75) Inventors: Sheng-Ho Yang, Tu-cheng (TW); Chun-Chieh Yang, Tu-cheng (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/383,971

(22) Filed: Mar. 31, 2009

(65) Prior Publication Data

US 2009/0246990 A1 Oct. 1, 2009

(30) Foreign Application Priority Data

Mar. 31, 2008 (TW) ..... 97205439 U

(51) Int. Cl.
*H01R 24/00* (2006.01)

(52) U.S. Cl. ..... 439/660; 439/79

(58) Field of Classification Search ..... 439/78, 439/79, 80, 350, 351, 352, 571, 660
See application file for complete search history.

(56) References Cited

U.S. PATENT DOCUMENTS 6,146,180 A * 11/2000 Betker et al. ..... 439/352
6,343,951 B1 * 2/2002 Ono et al. ..... 439/571
6,699,070 B1 * 3/2004 Wu ..... 439/574
6,776,664 B1 * 8/2004 Huang ..... 439/660
7,234,957 B2 * 6/2007 Wang ..... 439/353
7,517,323 B2 * 4/2009 Ng ..... 600/569
7,632,131 B2 * 12/2009 Lee ..... 439/353

FOREIGN PATENT DOCUMENTS

TW 265798 5/2005

* cited by examiner

*Primary Examiner*—Thanh-Tam T Le
(74) *Attorney, Agent, or Firm*—Wei Te Chung; Andrew C. Cheng; Ming Chieh Chang

(57) ABSTRACT

An electrical connector assembly comprises a first connector and a second connector, the first connector comprises a first insulative housing defining a guide groove extending from the top face to the bottom face, and a plurality of first terminals received in the first passageways; The second connector comprises a second insulative housing defining a guide post adapted to mate with the guide groove for fastening the first connector and the second connector, and a plurality of second terminals received in the second passageways, wherein the guide post penetrates through the guide groove and the transition portion of each first terminal respectively engages with the engagement section of corresponding second terminal when assembled together.

6 Claims, 6 Drawing Sheets

FLOATING ELECTRICAL CONNECTOR ASSEMBLY

BACKGROUND OF THE INVENTION

1. Field of the Invention

The present invention relates to an electrical connection device, and more particularly to a floating electrical connector assembly including a first connector and a second connector floatably mating with each other.

2. Description of Related Art

TW Pat. Issue No. 265798 issued to Zeng on Feb. 24, 2007, discloses an electrical connector assembly including a first connector 1 and a second connector 2 assembled together to be coupled between a backplane 3 in the computer and a male connector on a hard drive for establishing signal transmission between the hard drive 4 and the backplane 3 through the interconnections of such first and second connectors. The first connector 1 includes a dielectric housing 11 defining a plurality of passageways 113, and a plurality of terminals. Each terminal has a mating section received in a corresponding passageway 113, and a mating end protruding from the passageway 113 for mating with a corresponding terminal of the second connector 2. Since the mating ends are long and freely movable. Thus when the first connector 1 is mounted to the second connector 2, the mating ends are prone to misengage or even fail to engage with the corresponding terminals 22 of the second connector 2.

Hence, an improved electrical connector assembly is required to overcome the disadvantages of the prior art.

SUMMARY OF THE INVENTION

Accordingly, an object of the present invention is to provide an electrical connector assembly with a guide structure for connecting a media storing device with a printed circuit board, wherein reliable electrical connection is established between a first connector and a second connector of the electrical connector assembly.

In order to achieve the above-mentioned object, an electrical connector assembly comprises a first connector and a second connector. The first connector comprises a first insulative housing defining a mating portion with a front face and a back face, said mating portion including a first cavity and a second cavity divided by a partition, a plurality of first passageways extending through the housing from the front face to the back face and in communication with the first cavity and the second cavity, a guide groove adapted to penetrate through the housing and located adjacent said back face and at a location essentially aligned with said partition, and a plurality of first terminals received in the respective first passageways, each first terminal having a vertical flat back engaging portion extending beyond a corresponding passageway and exposed on said back face. The second connector for mating with the first connector comprises a second insulative housing defining a top face, a bottom face opposite to the top face, a forward face, a cutout on said forward face, a plurality of second passageways adapted to extending from the top face toward the bottom face and in communication with the cutout, and a guide post in correspondence with said guide groove, and a plurality of second terminals received in the respective second passageways, each second terminal having a forward engagement section exposed to said cutout on the forward face of the second housing; wherein the first connector mates with the second connector in a condition that the guide post penetrates through the guide groove and said vertical flat back engaging portion of the first terminal slidably engages with said forward engagement section of the second terminal.

Other objects, advantages and novel features of the present invention will become more apparent from the following detailed description of the present embodiment when taken in conjunction with the accompanying drawings.

DETAILED DESCRIPTION OF THE INVENTION

Figure 1:
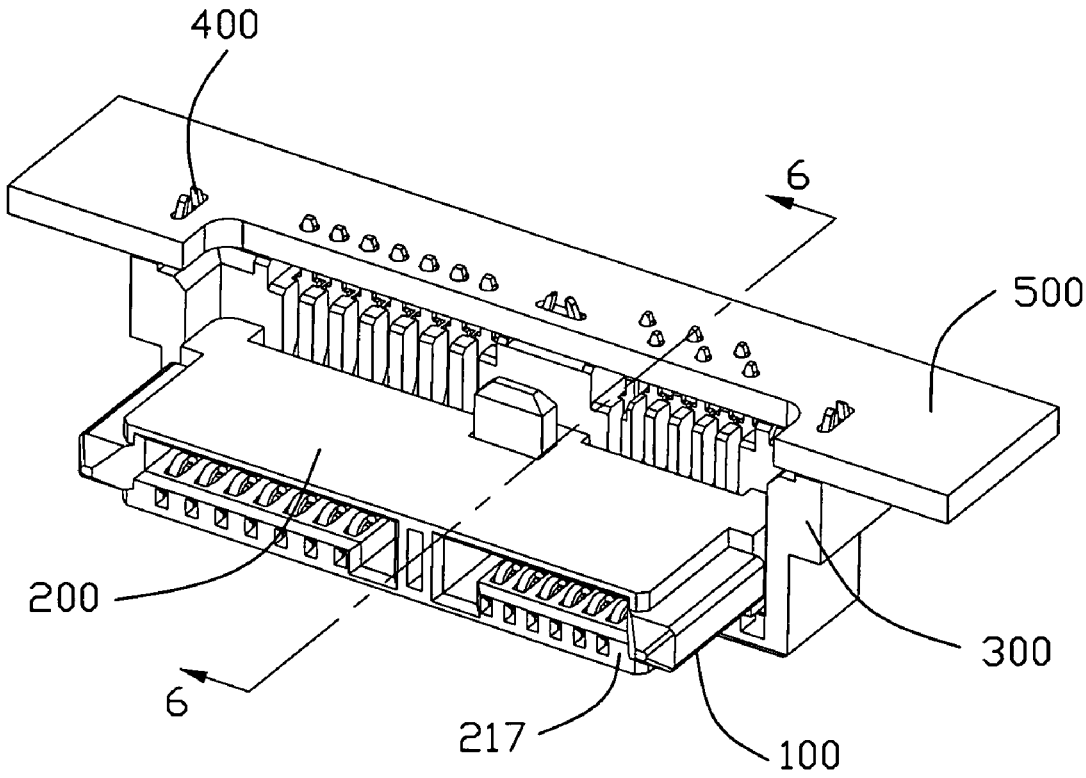
FIG. 1 is an assembled, perspective view of an electrical connector assembly according to an embodiment of the present invention.
Figure 2:
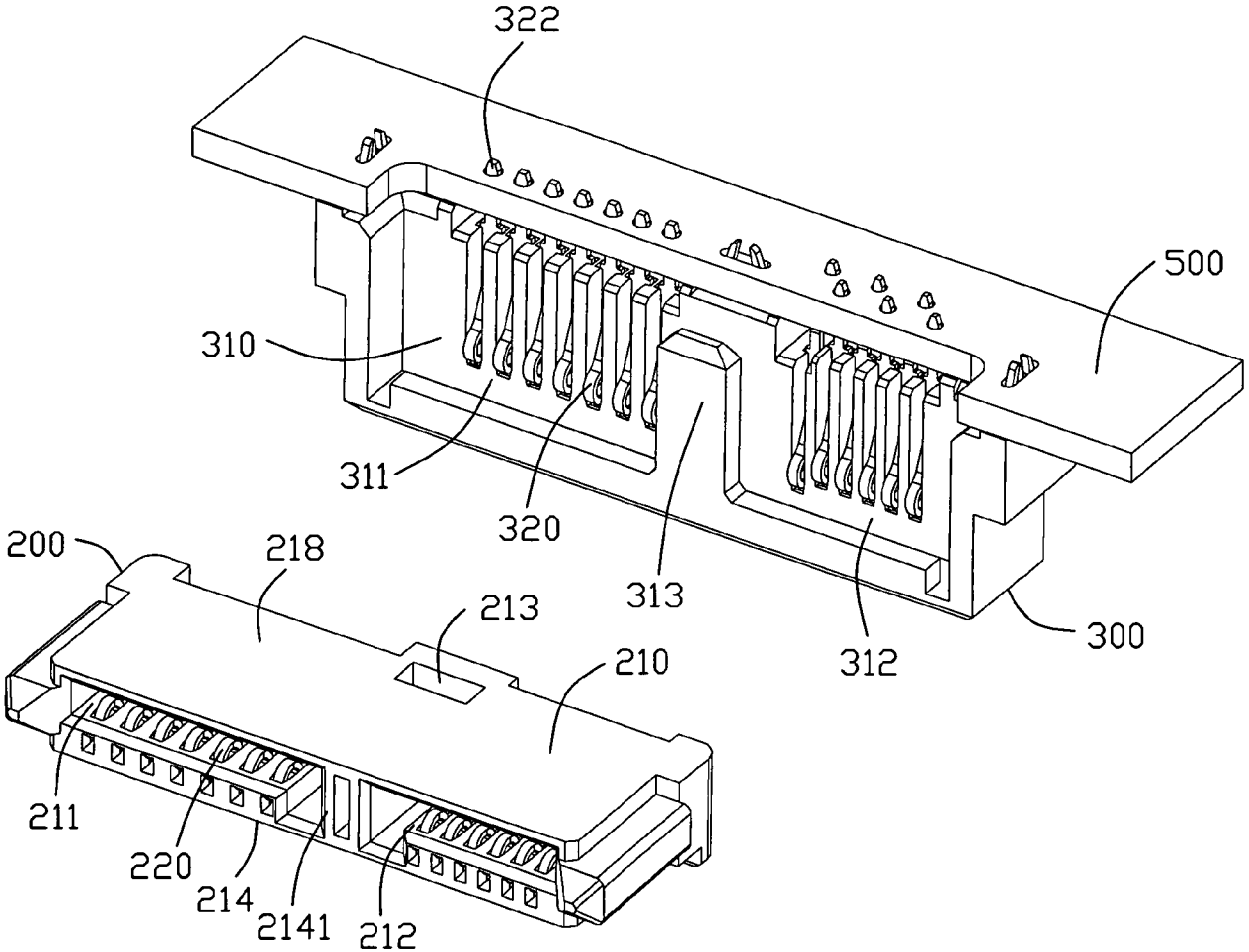
FIG. 2 is an exploded, perspective view of the electrical connector assembly of FIG. 1.

Referring to FIG. 1 to 2, a floating electrical connector assembly 100 according to an embodiment of the present invention is shown to include a first connector 200 and a second connector 300 floatably mating with each other.

Figure 3:
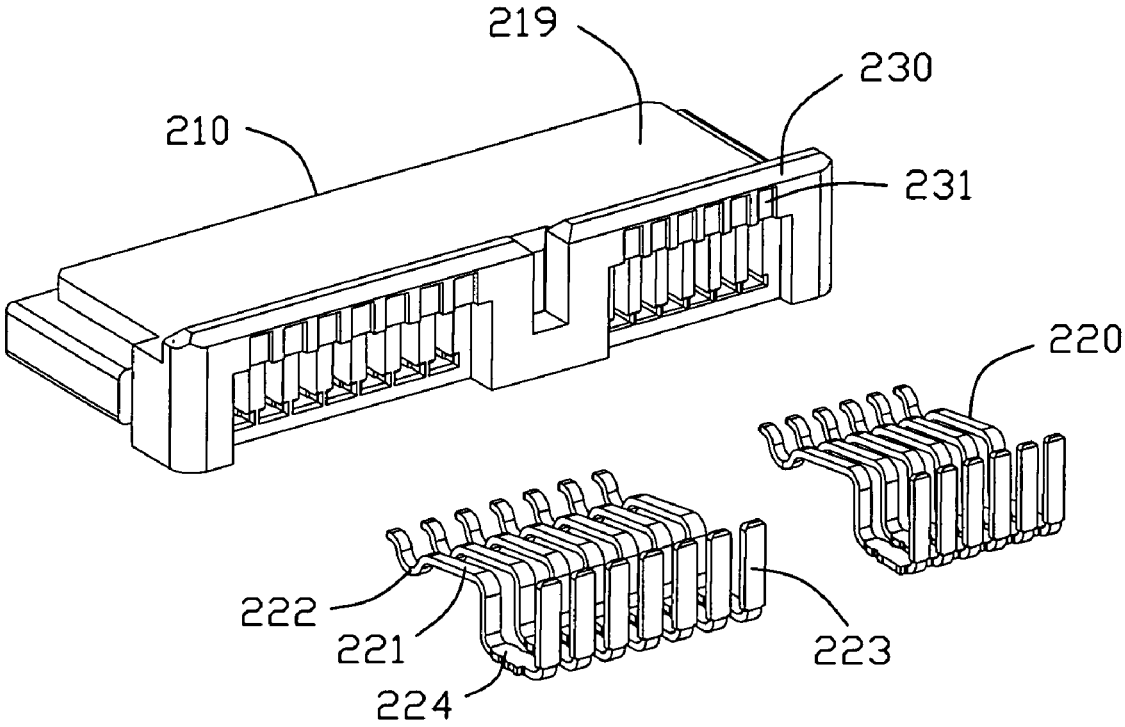
FIG. 3 is an exploded, perspective view of the first connector of FIG. 2.
Figure 4:
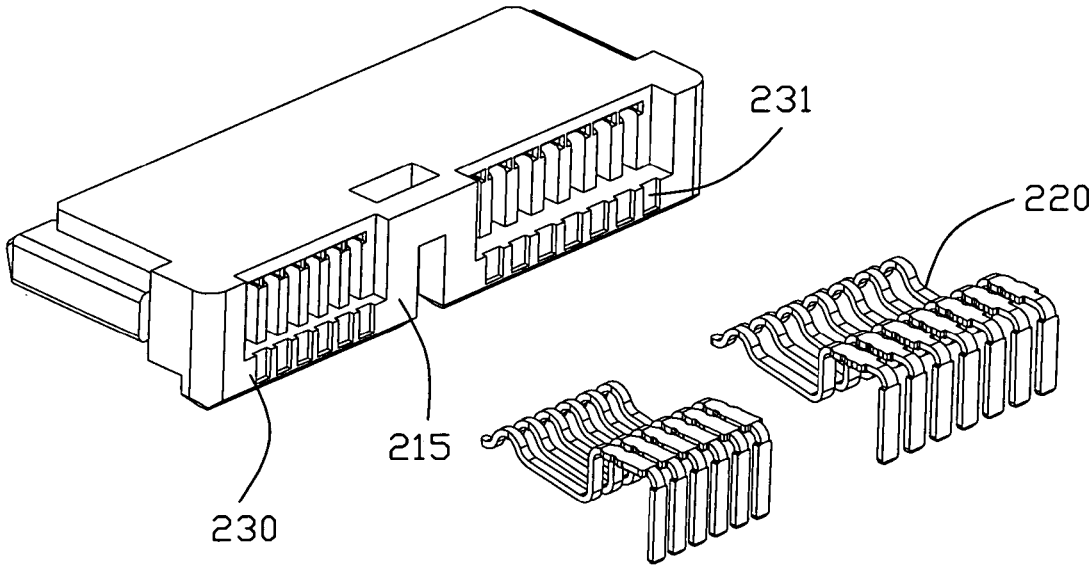
FIG. 4 is another perspective view of the first electrical connector of the interconnection system of FIG. 3.

Referring particularly to FIG. 3 to 4, the first connector 200 includes an first insulative housing 210 defining a mating portion 214 with a front mating face 217 and an opposite back face 215, said mating portion 214 further including a first cavity 211 and a second cavity 212 by a partition 2141, a top face 218, a bottom face 219 opposite to the top face 218, a plurality of first passageways 216 extending through the housing 210 from the front mating face 217 to the back face 215 and in communication with the first cavity 211 and the second cavity 212, and a guide groove 213 adapted to penetrate through the housing 210, said guide groove 213 located adjacent said back face 215 and at a location essentially aligned with said partition 2141.

The first connector 200 further comprises a plurality of first terminals 220 received in the first passageways 216 of the first housing 210, each first terminal 220 has a retention portion 224, a elastic portion 221 extending from the retention portion 224, a mating portion 222 extending into the first cavity 211 and the second cavity 212, and a vertical flat back engaging portion 223 extending beyond a corresponding passageway 216 and exposed on said back face 215; Each first passageways 216 has a top wall, the retention portion 224 of each first terminal 220 abuts against the top wall.

Figure 5:
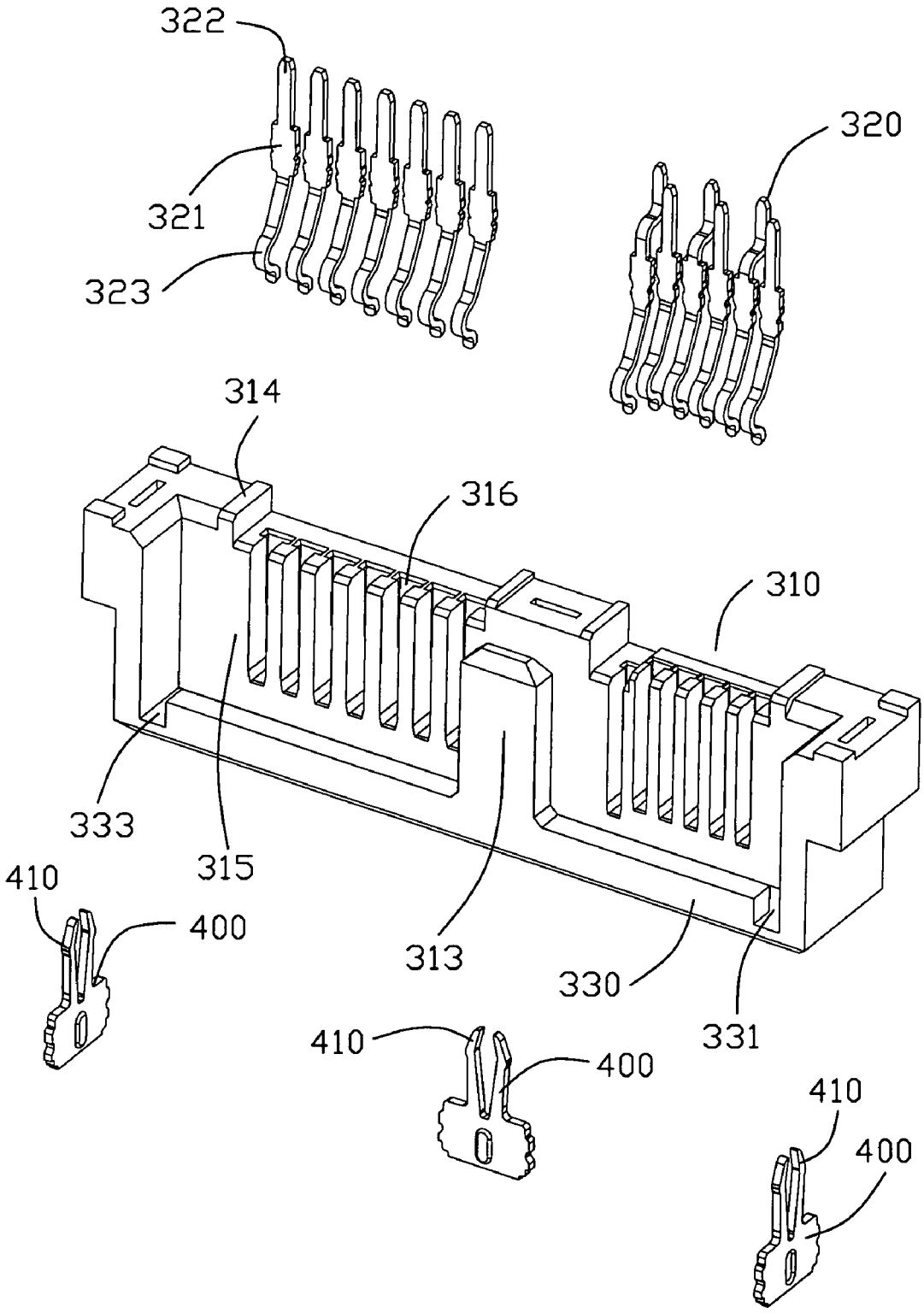
FIG. 5 is an exploded, perspective view of a second connector of the electrical connector assembly of FIG. 2.

Referring particularly to FIG. 5, the second connector 300 for mating with the first connector 200 comprises a second insulative housing 310 defining a top face 314, a bottom face 317 opposite to the top face 314, a forward face 315 between the top face 314 and the bottom face 317, a cutout 318 on said forward face 315, a plurality of second passageways 316 adapted to extend from the top face 314 toward the bottom face 317 and in communication with the cutout 318, and a guide post 313 in correspondence with said guide groove 213.

The second connector 300 further comprises a plurality of second terminals 320 received in the respective second passageways 316, each second terminal 320 has a retention section 321 secured in the second passageway 316, an forward engagement section 323 extending from the retention section 321 and exposed to said cutout 318 on the forward face 315 of the second insulative housing 310, and a soldered portion 322 extending from the retention section 321; wherein the first connector 200 mates with the second connector 300 in a condition that the guide post 313 penetrates through the guide groove 213 and said vertical flat back engaging portion 223 of the first terminal 220 slidably engages with said forward engagement section 323 of corresponding second terminal 320.

Figure 6:
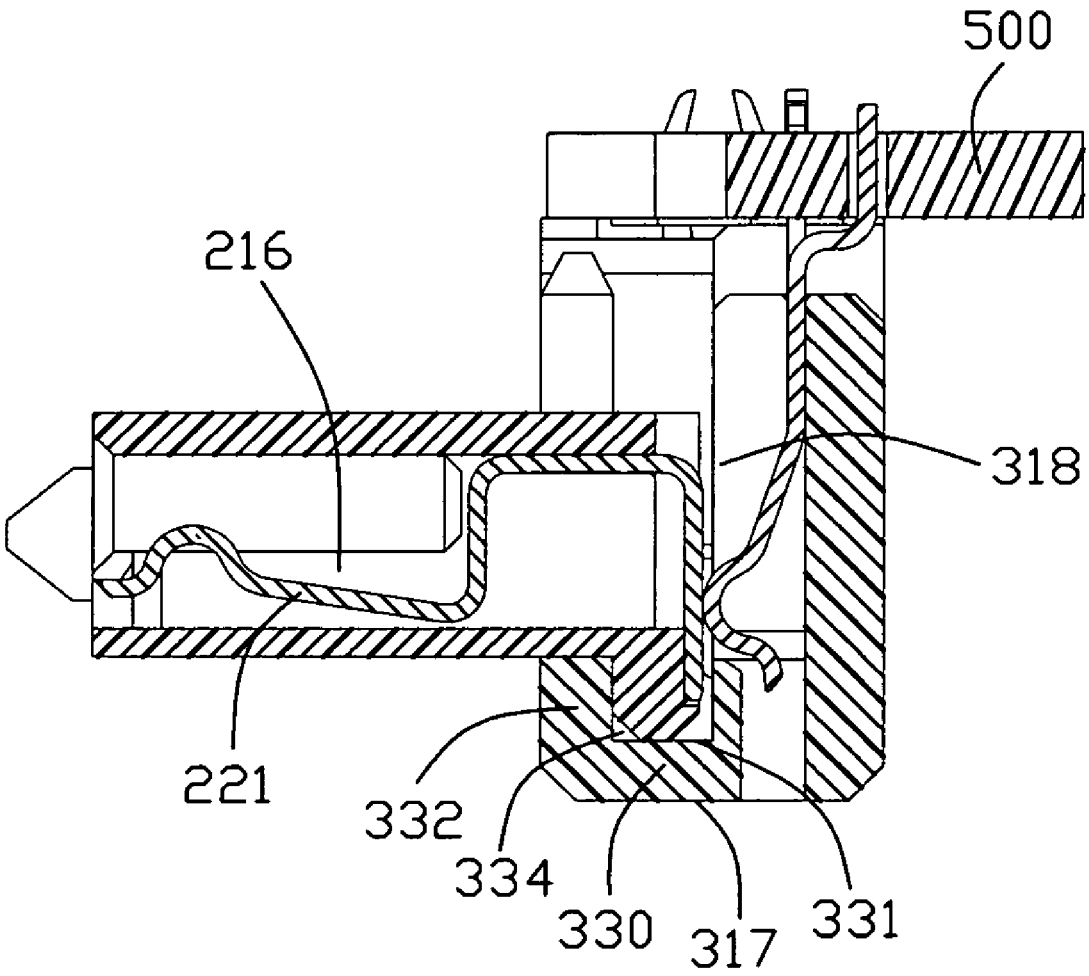
FIG. 6 is a cross-sectional view of the electrical connector assembly of FIG. 1, taken along the line 6-6.

Referring particularly to FIG. 6, the second insulative housing 310 further has a base section 330 defining a reference face 331, a rib 332 extending from the reference face 331, and a slot 334 is disposed between the rib 332 and the second abutment face 315. The first insulative housing 210 further comprises a projection 230 protruding from the bottom face 219 and adapted to mate with the slot 334 of the second insulative housing 310, the rib 332 has a pair of recesses 333 defining a lower face. The reference face 331 and the lower face are located on a common plane. In addition, the projection 230 has a plurality of depressions adapted to receive the tail end of the vertical flat back engaging portion 223 of corresponding first terminal 220.

The electrical connector assembly 100 further comprises three boardlocks 400 each having a pair of biased legs 410 upwardly extending beyond the top face 314 of the second housing 310 for being interferingly inserted into corresponding hole defined in the printed circuit board 500.

While a preferred embodiment in accordance with the present invention has been shown and described, equivalent modifications and changes known to persons skilled in the art according to the spirit of the present invention are considered within the scope of the present invention as described in the appended claims.

What is claimed is:

1. An electrical connector assembly, comprising:

a first connector, comprising:

a first insulative housing defining a front mating face, an opposite back face, a top face, an opposite bottom face, an elongated slot on said front mating face, a plurality of first passageways extending through the housing from the front mating face to the back face and in communication with the slot, and a guide groove penetrating through the housing from the top face to the opposite bottom face, said guide groove located adjacent said back face and at a location between opposite sides of said first housing;

a plurality of first terminals received in respective first passageways, each first terminal having a vertical flat back engaging portion extending beyond a corresponding passageway and exposed on said back face;

a second connector for mating with the first connector, comprising:

a second insulative housing defining a top face, a bottom face opposite to the top face, a forward face, a cutout on said forward face, a plurality of second passageways extending from the top face toward the bottom face and in communication with the cutout, and a guide post in correspondence with said guide groove;

a plurality of second terminals received in respective second passageways, each second terminal having a forward engagement section exposed to said cutout on the forward face of the second housing;

wherein the first connector mates with the second connector in a condition that the guide post penetrates through the guide groove and said vertical flat back engaging portion of the first terminal slidably engages with said forward engagement section of the second terminal;

wherein the first insulative housing includes a first cavity and a second cavity divided by a partition and the guide groove is aligned with the partition;

wherein the second insulative housing further has a base section defining a reference face, a rib extending from the reference face, the guiding post extending from the rib, and a slot is disposed between the rib and the forward face; and wherein the first insulative housing further comprises a projection protruding from the opposite bottom face and adapted to mate with the slot of the second insulative housing.

2. The electrical connector assembly as described in claim 1, wherein said projection has a plurality of depressions adapted to receive the tail end of the transition portion of corresponding first terminal.

3. The electrical connector assembly as described in claim 1, wherein the rib has a recess defining a lower face.

4. The electrical connector assembly as described in claim 3, wherein the reference face and the lower face are located on a common plane.

5. The electrical connector assembly as described in claim 1, further comprising a boardlock having a pair of biased legs upwardly extending beyond the top face of the second housing.

6. An electrical connector assembly, comprising:

a first connector, comprising:

a first insulative housing defining a mating portion with a front face and a back face, a top face, an opposite bottom face, said mating portion including a first cavity and a second cavity divided by a partition, a plurality of first passageways extending through the housing from the front face to the back face and in communication with the first cavity and the second cavity, a guide groove adapted to penetrate through the housing from the top face to the opposite bottom face and located adjacent said back face and at a location essentially aligned with said partition;

a plurality of first terminals received in the respective first passageways, each first terminal having a vertical flat back engaging portion extending beyond a corresponding passageway and exposed on said back face;

a second connector for mating with the first connector, comprising:

a second insulative housing defining a top face, a bottom face opposite to the top face, a forward face, a cutout on said forward face, a plurality of second passageways adapted to extending from the top face toward the bottom face and in communication with the cutout, and a guide post in correspondence with said guide groove;

a plurality of second terminals received in the respective second passageways, each second terminal having a forward engagement section exposed to said cutout on the forward face of the second housing;

wherein the first connector mates with the second connector in a condition that the guide post penetrates through the guide groove and said vertical flat back engaging portion of the first terminal slidably engages with said forward engagement section of the second terminal;

wherein the guide groove is aligned with the partition;

wherein the second insulative housing further has a base section defining a reference face, a rib extending from the reference face, the guiding post extending from the rib, and a slot is disposed between the rib and the forward face; and wherein the first insulative housing further comprises a projection protruding from the opposite bottom face and adapted to mate with the slot of the second insulative housing.

* * * * *